US006899306B1

(12) United States Patent
Huang

(10) Patent No.: US 6,899,306 B1
(45) Date of Patent: May 31, 2005

(54) FOLDING COLLAPSIBLE STAND FOR TABLE SAW

(75) Inventor: Peter Huang, Taichung (TW)

(73) Assignee: Durq Machinery Corp., Taichung (TW)

( * ) Notice: Subject to any disclaimer, the term of this patent is extended or adjusted under 35 U.S.C. 154(b) by 0 days.

(21) Appl. No.: 10/800,617

(22) Filed: Mar. 16, 2004

(30) Foreign Application Priority Data

Dec. 17, 2003 (TW) ..... 92222133 U

(51) Int. Cl.[7] ..... A47G 23/02

(52) U.S. Cl. ..... 248/150; 108/118; 248/188.1; 248/436

(58) Field of Search ..... 248/436, 150, 248/151, 164, 166, 188.1; 108/118, 119; 83/477.2; 182/153, 129

(56) References Cited

U.S. PATENT DOCUMENTS

| | | | | |
|---|---|---|---|---|
| 6,719,250 | B2 * | 4/2004 | FitzSimons | 248/166 |
| 6,722,293 | B2 * | 4/2004 | Lee | 108/118 |
| 6,814,333 | B1 * | 11/2004 | Freiburger | 248/150 |
| 2004/0051009 | A1 * | 3/2004 | Chen | 248/163.1 |
| 2004/0084581 | A1 * | 5/2004 | Chang | 248/166 |

* cited by examiner

*Primary Examiner*—Ramon O Ramirez
(74) *Attorney, Agent, or Firm*—Bacon & Thomas PLLC

(57) ABSTRACT

A folding collapsible stand for supporting a table saw includes a rectangular top frame and a plurality of folding collapsible legs respectively pivoted to the top frame and respectively formed of a top tube, a bottom tube, a connector, and a pivot. The connector is mounted in the bottom tube, having a top stop device and two bottom extension strips. The bottom extension strips each have a knob that is engaged into a locating hole in the bottom tube to hold the top tube and the bottom tube in straight when the respective folding collapsible leg is extended out. Pressing the knob of each bottom extension strip away from the locating hole of the bottom tube allows the bottom tube to be turned relative to the top tube to a collapsed position.

7 Claims, 11 Drawing Sheets

FOLDING COLLAPSIBLE STAND FOR TABLE SAW

BACKGROUND OF THE INVENTION

1. Field of the Invention

The present invention relates to a table saw and more specifically, to a folding collapsible stand for supporting a table saw.

2. Description of the Related Art

A table saw is generally equipped with a folding collapsible stand. A folding collapsible stand for table saw is known comprising a rectangular top frame, and four legs pivoted to the bottom side of the rectangular top frame in the four corners and arranged in two crossed pairs. When in use, the legs are turned relative to the frame to a posture that can support the table saw on the floor. When not in use, the legs are turned upwards and closely received to the bottom side of the rectangular top frame. When collapsed the legs each have the bottom end protruded over the periphery of the rectangular top frame at a distance. Because the legs protrude over the periphery of the rectangular top frame at a distance, the collapsed folding collapsible stand still occupies much storage space.

SUMMARY OF THE INVENTION

It is primary objective of the present invention to provide a folding collapsible stand for table saw, which requires less storage space when collapsed.

It is another objective of the present invention to provide a folding collapsible stand for table saw, which has the legs made foldable so that the storage space can be minimized when collapsed.

To achieve these objectives of the present invention, the folding collapsible stand for supporting a table saw comprises a rectangular top frame, and a plurality of folding collapsible legs respectively pivoted to the rectangular top frame and turnable between an extended position for supporting the table saw and a received position received to the bottom side of the table saw. Each folding collapsible leg comprises a top tube, a bottom tube, a connector, and a pivot. The top tube has a bottom end, a pivot hole transversely disposed near the bottom end, and a notch disposed at an inner side and longitudinally extended to the bottom end. The bottom tube comprises a top end, a longitudinal slot and a locating hole disposed in an upper part thereof. The connector comprises a hollow rectangular base fitted into the top end of the bottom tube, a through hole extended through two opposite sidewalls of the hollow rectangular base, two bottom extension strips respectively downwardly extended from the hollow rectangular base at two sides, two semispherical knobs respectively formed on the bottom extension strips at an outer side remote from the hollow rectangular base, and a top stop device formed on the top side of the hollow rectangular base. The pivot is inserted through the pivot hole of the top tube, the longitudinal slot of the bottom tube and the through hole of the hollow rectangular base of the connector to pivotally secure the bottom tube to the connector and the top tube such that when the corresponding folding collapsible leg is turned to the extended position, the semispherical knobs of the connector are respectively engaged into the locating hole of the bottom tube and the pivot is stopped at the bottom end of the longitudinal slot. When pressed the semispherical knobs inwards, the semispherical knobs are respectively disengaged from the locating hole of the bottom tube for enabling the bottom tube to be pulled downwards relative to the top tube to move the pivot to the top end of the longitudinal slot and then turned about the pivot toward the notch to the received position to force the stop device against the inside wall of the top tube.

DETAILED DESCRIPTION OF THE INVENTION

Figure 1:
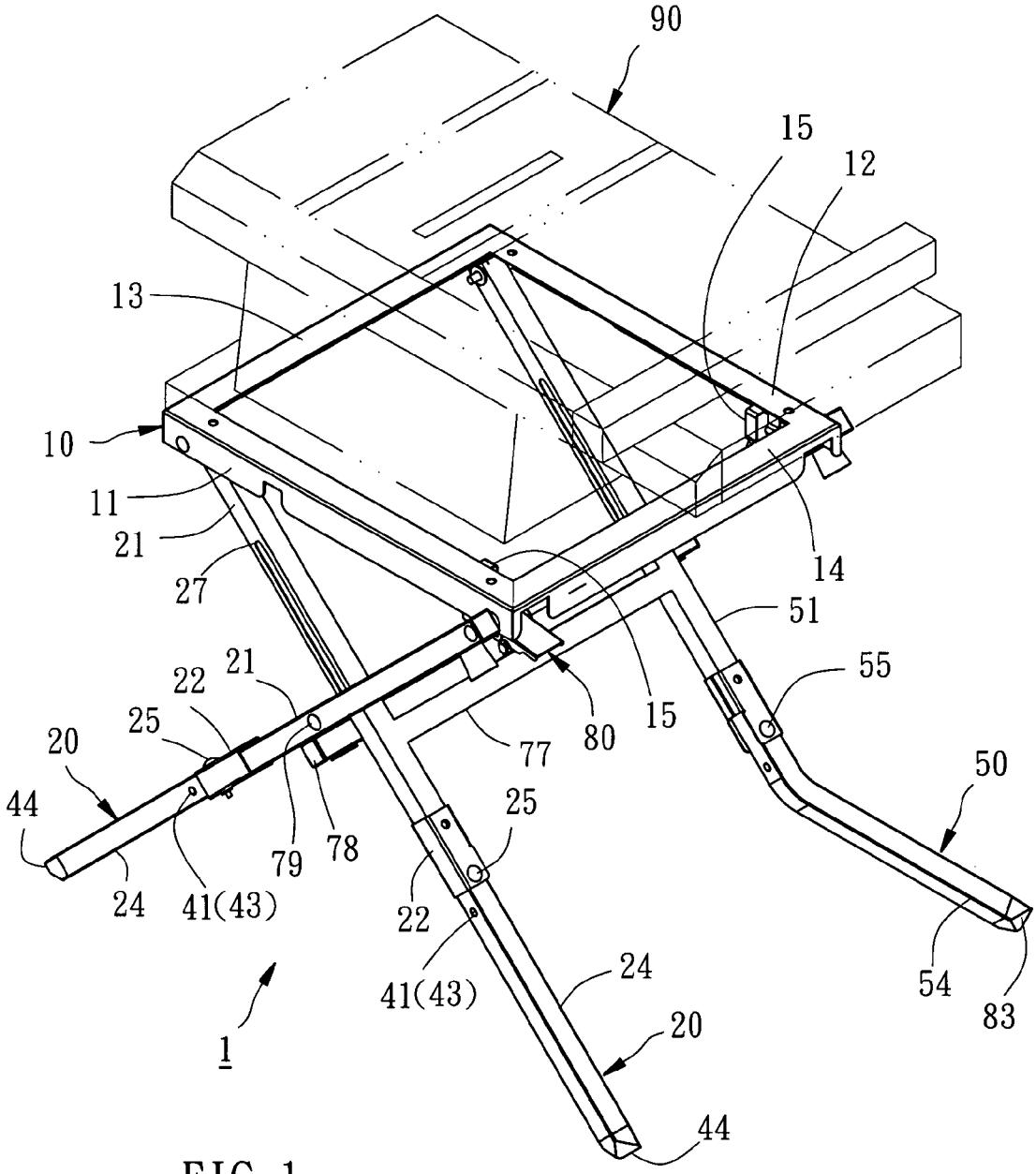
FIG. 1 is a perspective view of a folding collapsible stand for table saw according to the present invention.
Figure 2:
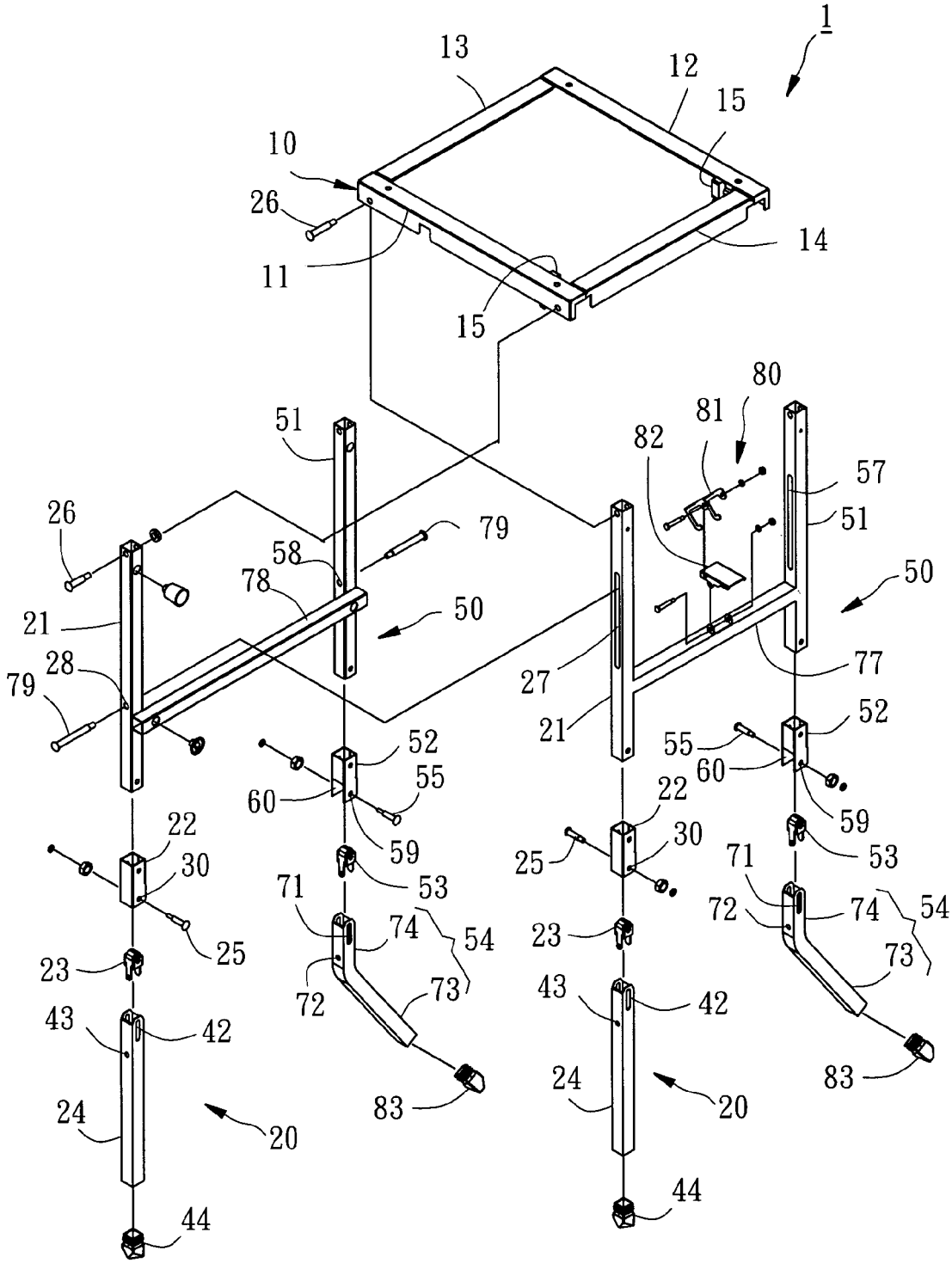
FIG. 2 is an exploded view of the folding collapsible stand for table saw according to the present invention.

As shown in FIGS. 1 and 2, a folding collapsible stand 1 is shown comprising a rectangular top frame 10, two first legs 20 fastened pivotally with the front side of the rectangular top frame 10, and two second legs 50 fastened pivotally with the rear side of the rectangular top frame 10.

The rectangular top frame 10 is adapted to support a table saw 90, comprising a front bar 11, a rear bar 12, a left-side bar 13, and a right-side bar 14. The left-side bar 13 and the right-side bar 14 are connected in parallel between the ends of the front bar 11 and the rear bar 12. The front bar 11 and the rear bar 12 each have a substantially inverted U-shaped clamping plate 15 downwardly extended from the bottom side adjacent to the right-side bar 14.

Figure 6:
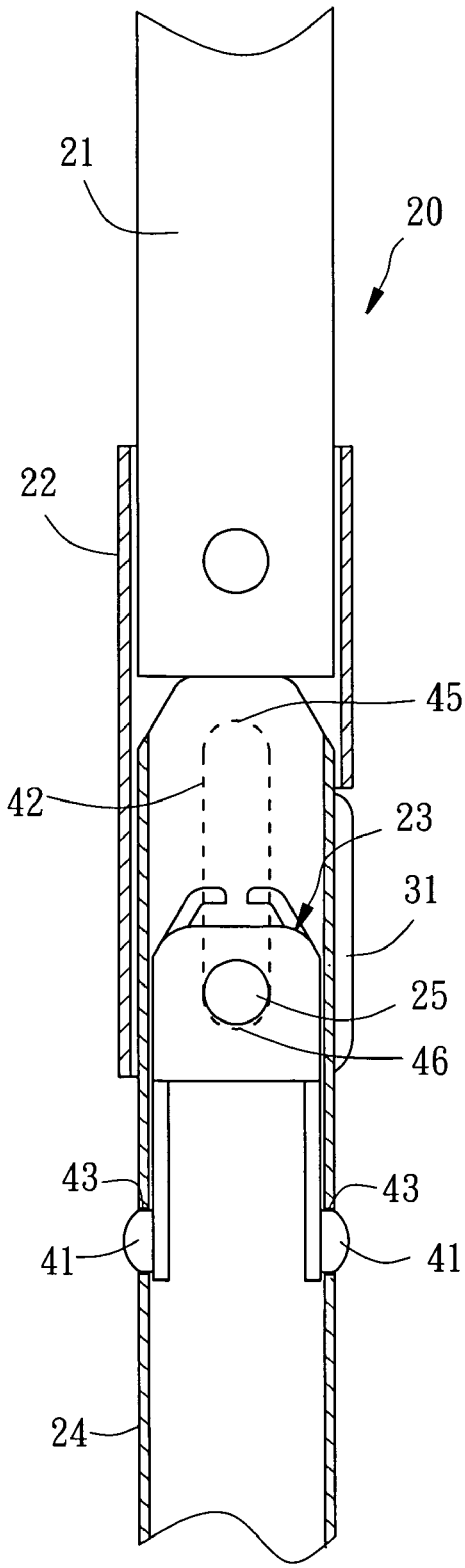
FIG. 6 is a sectional view in an enlarged scale of a part of the present invention showing the pivot of one first leg stopped at the bottom edge of the corresponding longitudinal slot.

The first legs 20 each comprise a top tube 21, a connector 23, a bottom tube 24, and a pivot 25. The top tube 21 and the bottom tube 24 are rectangular tubes. The top tube 21 has one end, namely, the top end pivoted to the front bar 11 of the rectangular top frame 10 by a screw bolt 26 in such a manner that the top tube 21 of one of the first legs 20 is disposed at the inner side of the left end of the front bar 11 and the top tube 21 of the other of the first legs 20 is disposed at the outer side of the right end of the front bar 11. The top tube 21 which is disposed at the inner side of the left end of the front bar 11 has a longitudinal guide slot 27. The top tube 21 which is disposed at the outer side of the right end of the front bar 11 has a transversely extended through hole 28. The bottom end of the top tube 21 of each first leg 20 is respectively mounted with a coupling tube 22. The coupling tube 22 is a rectangular tube 22 having the top end fixedly sleeved onto the bottom end of the respective top tube 21 and the bottom end provided with a transversely extended pivot hole 30 and a longitudinally extended bottom notch 31 (see FIG. 6).

Figure 3:
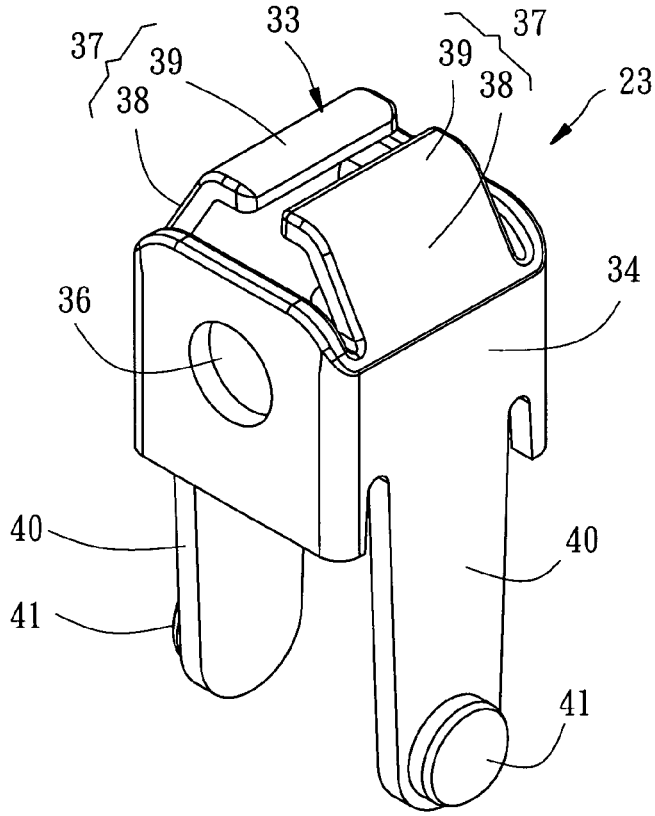
FIG. 3 is a perspective view of the connector of one first leg of the folding collapsible stand for table saw according to the present invention.

The connector 23 of each first leg 20 is molded from plastics. As shown in FIG. 3, the connector 23 comprises a hollow rectangular base 34, a through hole 36 extended through two opposite sidewalls of the hollow rectangular base 34, two bottom extension strips 40 respectively downwardly extended from the other two opposite sidewalls of the hollow rectangular base 34, two semispherical knobs 41 respectively formed on the free (bottom) ends of the extension strips 40 at an outer side, and a top stop device 33 formed on the top side of the hollow rectangular base 34. The top stop device 33 comprises two curved stop plates 37 respectively bilaterally extended from two opposite sidewalls of the hollow rectangular base 34 at the top corresponding to the bottom extension strips 40 and curved toward each other. Each curved stop plate 37 has a bottom sloping portion 38 obliquely extended from the hollow rectangular base 34, and a top bearing portion 39 horizontally extended from the top side of the bottom sloping portion 38.

The bottom tube 24 of each first leg 20 comprises a longitudinal slot 42 cut through the left and right tube walls near the top, a circular locating hole 43 transversely extended through the front and rear tube walls below the elevation of the longitudinal slot 42, a foot member 44 fastened to the bottom end. The connector 23 of each first leg 20 is fastened to the inside of the top end of the respective bottom tube 24.

The pivot 25 of each first leg 20 is a screw bolt inserted through the pivot hole 30 of the corresponding coupling tube 22, the longitudinal slot 42 of the corresponding bottom tube 24 and the through hole 36 of the corresponding connector 23 to join the corresponding top tube 21 and the corresponding bottom tube 24, for enabling the corresponding bottom tube 24 to be pivoted relative to the corresponding top tube 21.

Figure 7:
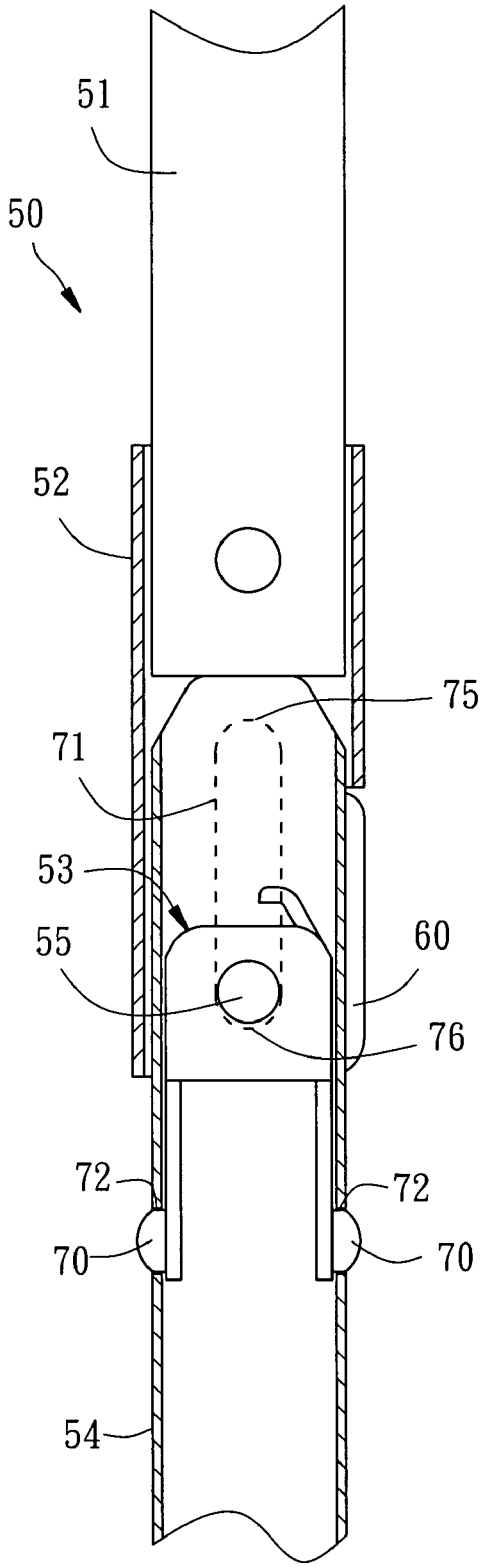
FIG. 7 is a sectional view in an enlarged scale of a part of the present invention showing the pivot of one second leg stopped at the bottom edge of the corresponding longitudinal slot.

The second legs 50 each comprise a top tube 51, a connector 53, a bottom tube 54, and a pivot 55. The top tube 51 and the bottom tube 54 are rectangular tubes. The top tube 51 has one end, namely, the top end pivoted to the rear bar 12 of the rectangular top frame 10 in such a manner that the top tube 51 of one of the second legs 50 is disposed at the inner side of the left end of the rear bar 12 and the top tube 51 of the other of the second legs 50 is disposed at the outer side of the right end of the rear bar 12. The top tube 51 which is disposed at the inner side of the left end of the rear bar 12 has a longitudinal guide slot 57. The top tube 51 which is disposed at the outer side of the right end of the rear bar 12 has a transversely extended through hole 58. The bottom end of the top tube 51 of each second leg 50 is respectively mounted with a coupling tube 52. The coupling tube 52 is a rectangular tube having the top end fixedly sleeved onto the bottom end of the respective top tube 51 and the bottom end provided with a transversely extended pivot hole 59 and a longitudinally extended bottom notch 60 (see FIG. 7).

Figure 4:
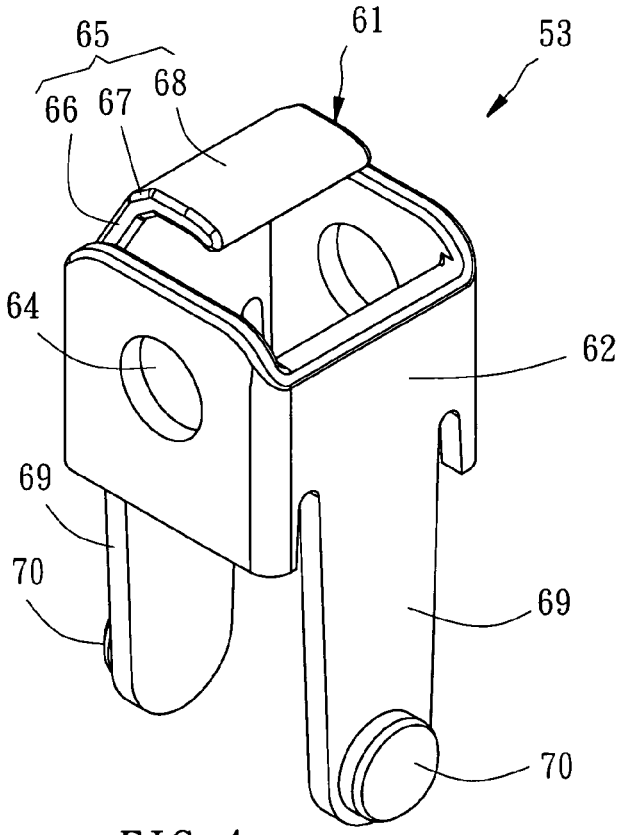
FIG. 4 is a perspective view of the connector of one second leg of the folding collapsible stand for table saw according to the present invention.

The connector 53 of each second leg 50 is molded from plastics. As shown in FIG. 4, the connector 53 comprises a hollow rectangular base 62, a through hole 64 extended through two opposite sidewalls of the hollow rectangular base 62, two bottom extension strips 69 respectively downwardly extended from the other two opposite sidewalls of the hollow rectangular base 62, two semispherical knobs 70 respectively formed on the free (bottom) ends of the extension strips 69 at an outer side, and a top stop device 61 formed on the top side of the hollow rectangular base 62. The top stop device 61 comprises a curved stop plate 65 upwardly extended from the hollow rectangular base 62 at the top. The curved stop plate 65 has a bottom sloping portion 66 obliquely extended from the hollow rectangular base 62, and a top horizontal endpiece 68, and a curved bearing portion 67 connected between the bottom sloping portion 66 and the top horizontal endpiece 68.

The bottom tube 54 of each second leg 50 has a top straight section 74 and a bottom oblique section 73 extended from the bottom end of the top straight section 74 at an angle. The top straight section 74 has a longitudinal slot 71 cut through the left and right tube walls near the top, and a circular locating hole 72 transversely extended through the front and rear tube walls near the bottom. The bottom oblique section 73 has the bottom end mounted with a foot member 83. The connector 53 of each second leg 50 is fastened to the inside of the top end of the top straight section 74 of the corresponding bottom tube 54.

The pivot 55 of each second leg 50 is a screw bolt inserted through the pivot hole 59 of the corresponding coupling tube 52, the longitudinal slot 71 of the corresponding bottom tube 54 and the through hole 64 of the corresponding connector 53 to join the corresponding top tube 51 and the corresponding bottom tube 54, for enabling the corresponding bottom tube 54 to be pivoted relative to the corresponding top tube 51.

Further, a first crossbar 77 is connected between one first leg 20 and one second leg 50 (the first leg and the second leg at the inner side of the rectangular top frame 10), and a second crossbar 78 is connected between the other first leg 20 and the other second leg 50 (the first leg and the second leg at the outer side of the rectangular top frame 10). A locking device 80 is provided at the first crossbar 77 on the middle. The locking device 80 comprises a handle 82 pivoted to the first crossbar 77, and a hook 81 pivoted to the handle 82. Two pivot rods 79 are respectively fastened to the transversely extended through hole 28 and longitudinal guide slot 27 of the first legs 20 and the transversely extended through hole 58 and longitudinal guide slot 57 of the second legs 50, keeping the two first legs 20 and the two second legs 50 arranged in a crossed manner.

After explanation of the component parts of the folding collapsible stand for table saw and their relative positioning, the folding operation of the folding collapsible stand for table saw will be described hereinafter.

Figure 5:
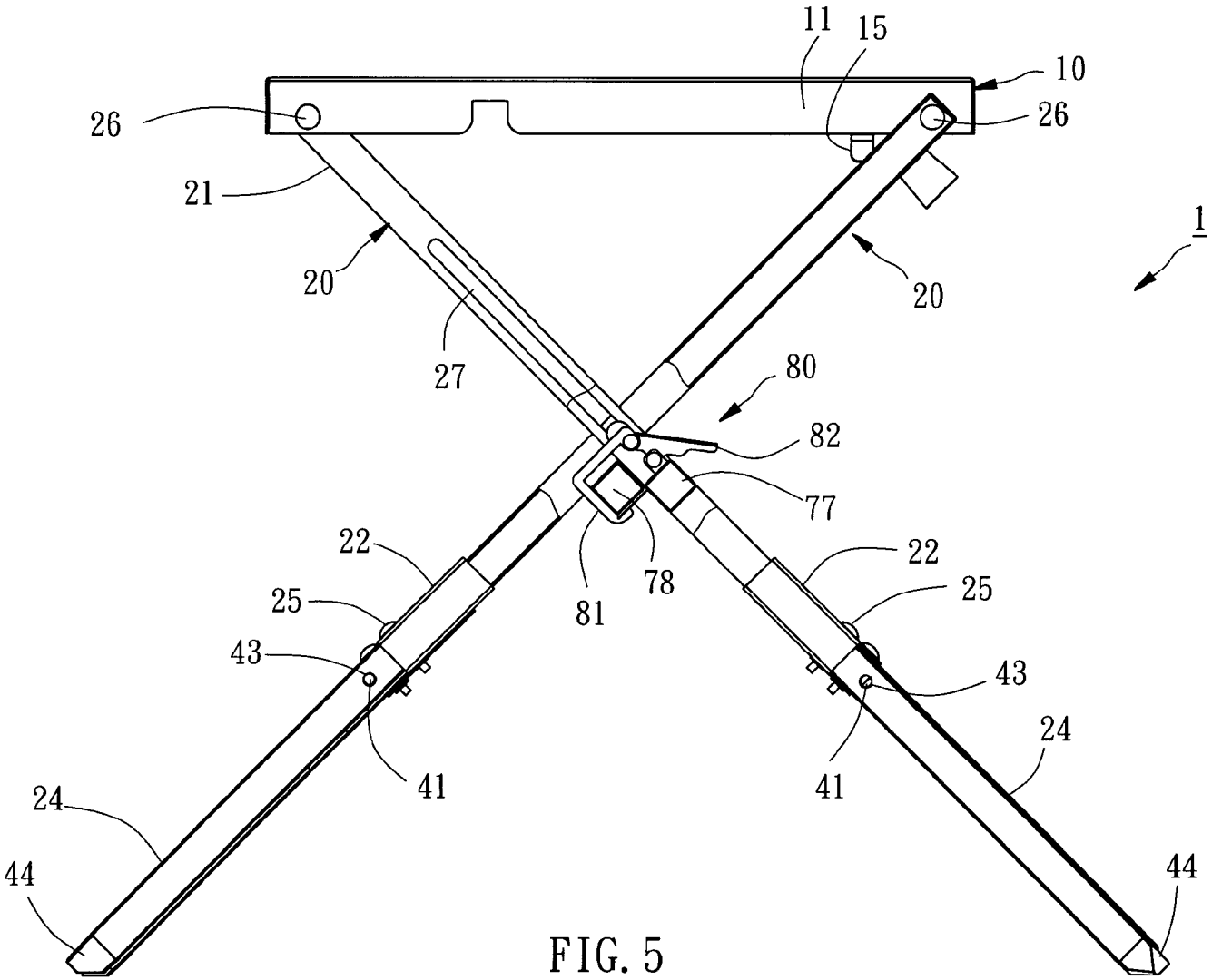
FIG. 5 is a front view of the present invention, showing the locking device fastened to the second crossbar.

FIG. 1 shows the extended status of the folding collapsible stand for table saw. At this time, the knobs 41 of the connectors 23 of the first legs 20 are respectively engaged in the circular locating holes 43 of the bottom tubes 24 of the first legs 20 and the pivots 25 of the first legs 20 are respectively stopped at the bottom edges 46 of the longitudinal slots 42 of the bottom tubes 24 of the first legs 20 (see FIG. 6); the knobs 70 of the connectors 53 of the second legs 50 are respectively engaged in the circular locating holes 72 of the bottom tubes 54 of the second legs 50 and the pivots 55 of the second legs 50 are respectively stopped at the bottom edges 76 of the longitudinal slots 71 of the bottom tubes 54 of the second leg s 50 (see FIG. 7); and the hook 81 is hooked on the second crossbar 78 (see FIG. 5). Therefore, the legs 20 and 50 are held in the extended position and supported on the floor firmly and stably.

Figure 8:
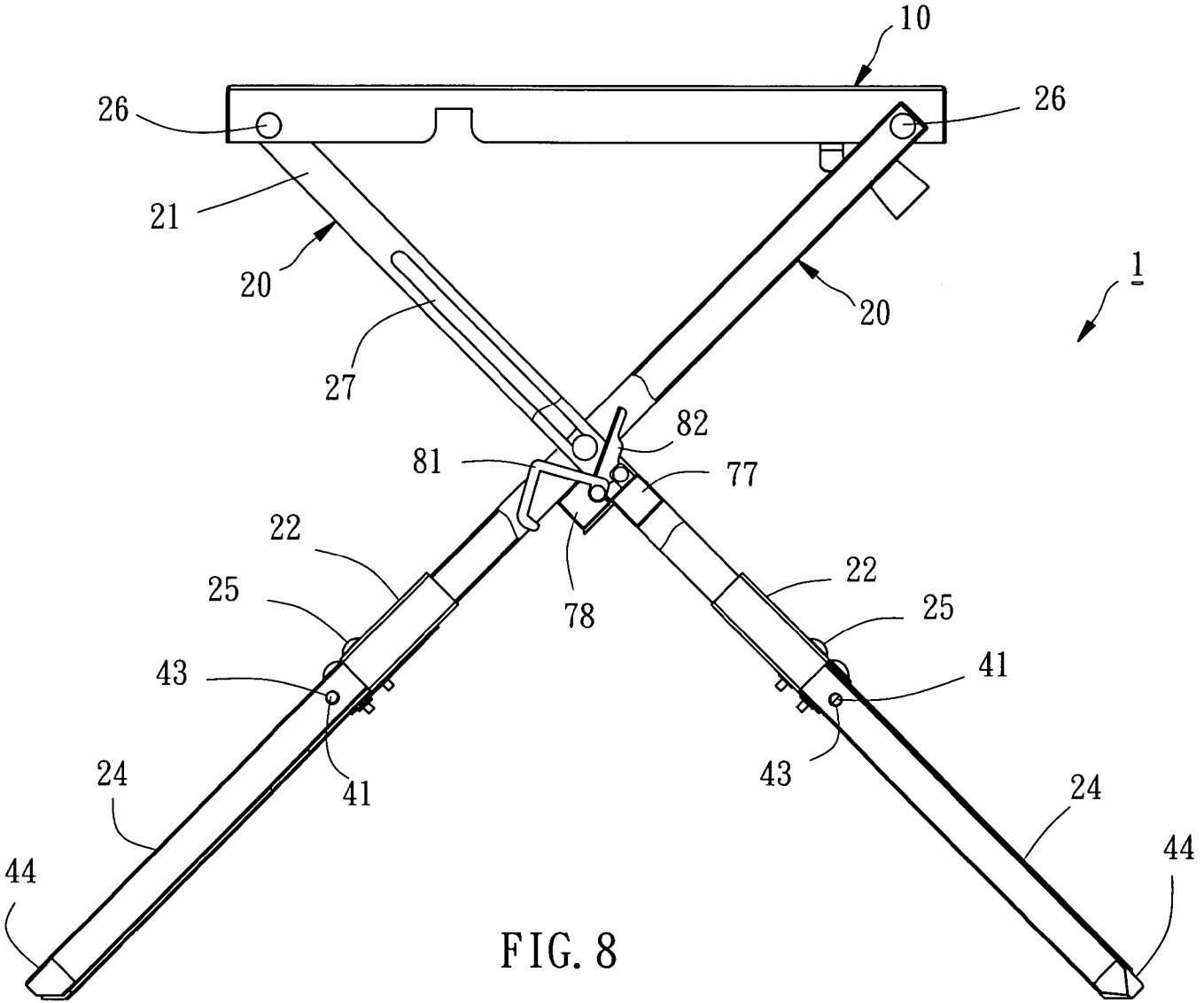
FIG. 8 is similar to FIG. 5 but showing the locking device disengaged from the second crossbar.
Figure 9:
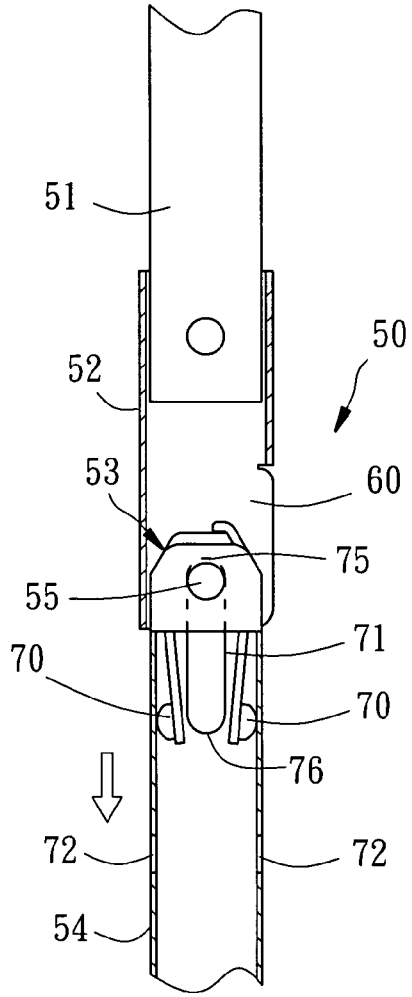
FIG. 9 is similar to FIG. 7 but showing the pivot stopped at the top edge of the corresponding longitudinal slot.
Figure 10:
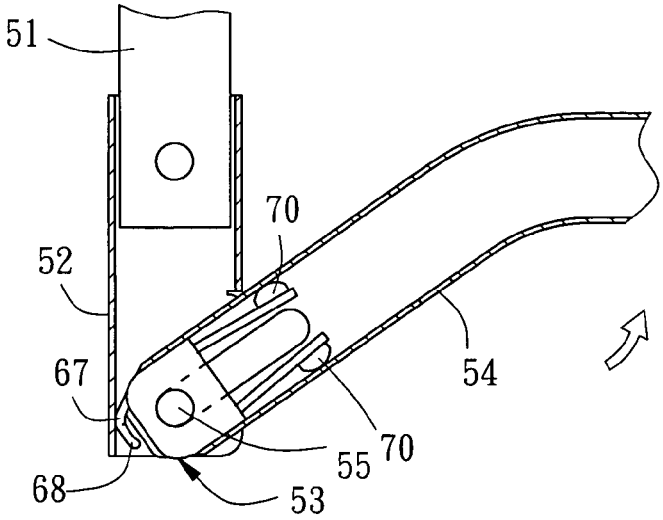
FIG. 10 is a sectional view in an enlarged scale of a part of one second leg of the folding collapsible stand for stable saw according to the present invention, showing the bottom tube turned to the collapsed position.
Figure 11:
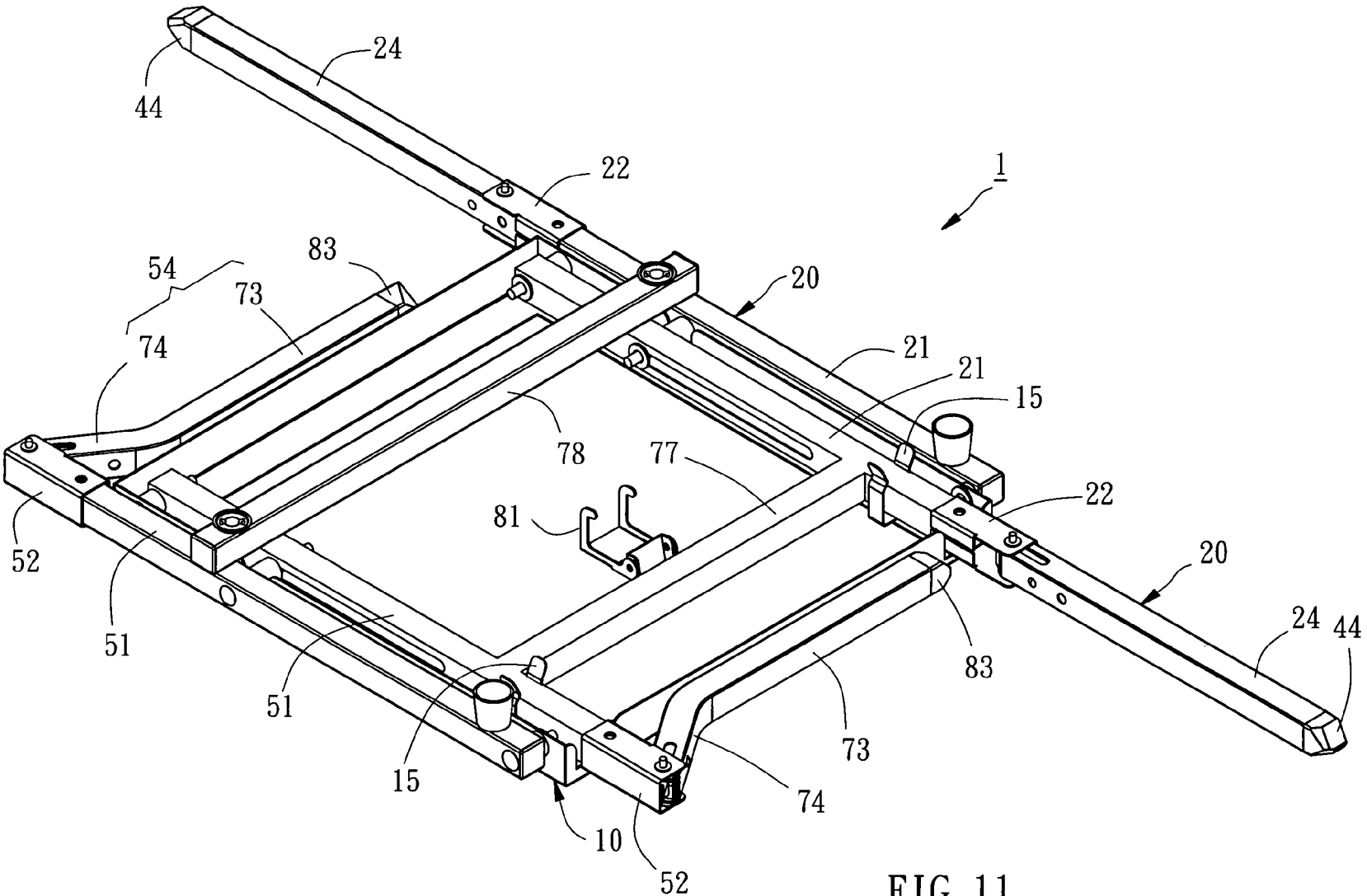
FIG. 11 is a perspective bottom view of the present invention, showing the received status of the second legs.

Referring to FIG. 8, when wishing to collapse the folding collapsible stand 1, lift the handle 82 to disengage the hook 81 from the second crossbar 78, and then turn the first legs 20 and the second legs 50 toward the bottom side of the rectangular top frame 10 to force the top tubes 21 and 51 of the inner first leg 20 and inner second leg 50 into engagement with the two inverted U-shaped clamping plates 15, and then collapse the second legs 50 (see FIGS. 9–11), and finally collapse the first legs 20 (see FIGS. 12–15). When collapsing the second legs 50, press the knobs 70 inwardly away from the locating holes 72 (see FIG. 9), and then pull the respective bottom tubes 54 out of the respective top tubes 51 to the extent that the pivots 55 are respectively stopped at the respective top edges 75 of the respective longitudinal slots 71, and then turn the respective bottom tubes 54 about the respective pivots 55 toward the corresponding bottom notches 60, as shown in FIGS. 10 and 11, to force the endpieces 68 of the respective top stop devices 61 over the inside walls of the corresponding coupling tubes 52 till the curved bearing portions 67 of the stop devices 61 are respectively stopped against the inside walls of the corresponding coupling tubes 52.

Figure 12:
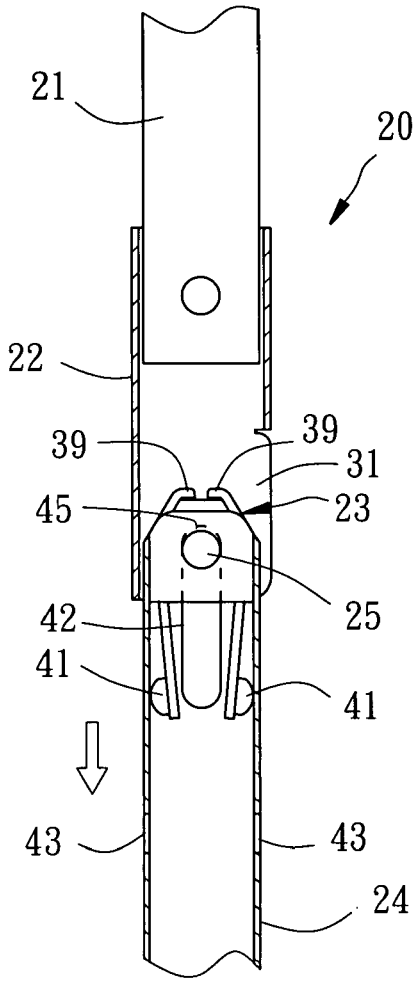
FIG. 12 is similar to FIG. 6 but showing the pivot stopped at the top edge of the corresponding longitudinal slot.
Figure 13:
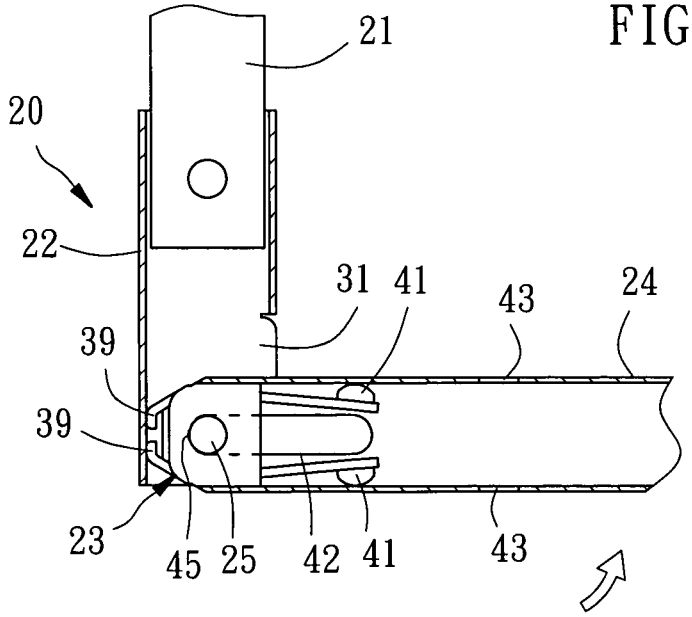
FIG. 13 is a sectional view in an enlarged scale of a part of one first leg of the folding collapsible stand for stable saw according to the present invention, showing the bottom tube turned to the collapsed position.
Figure 14:
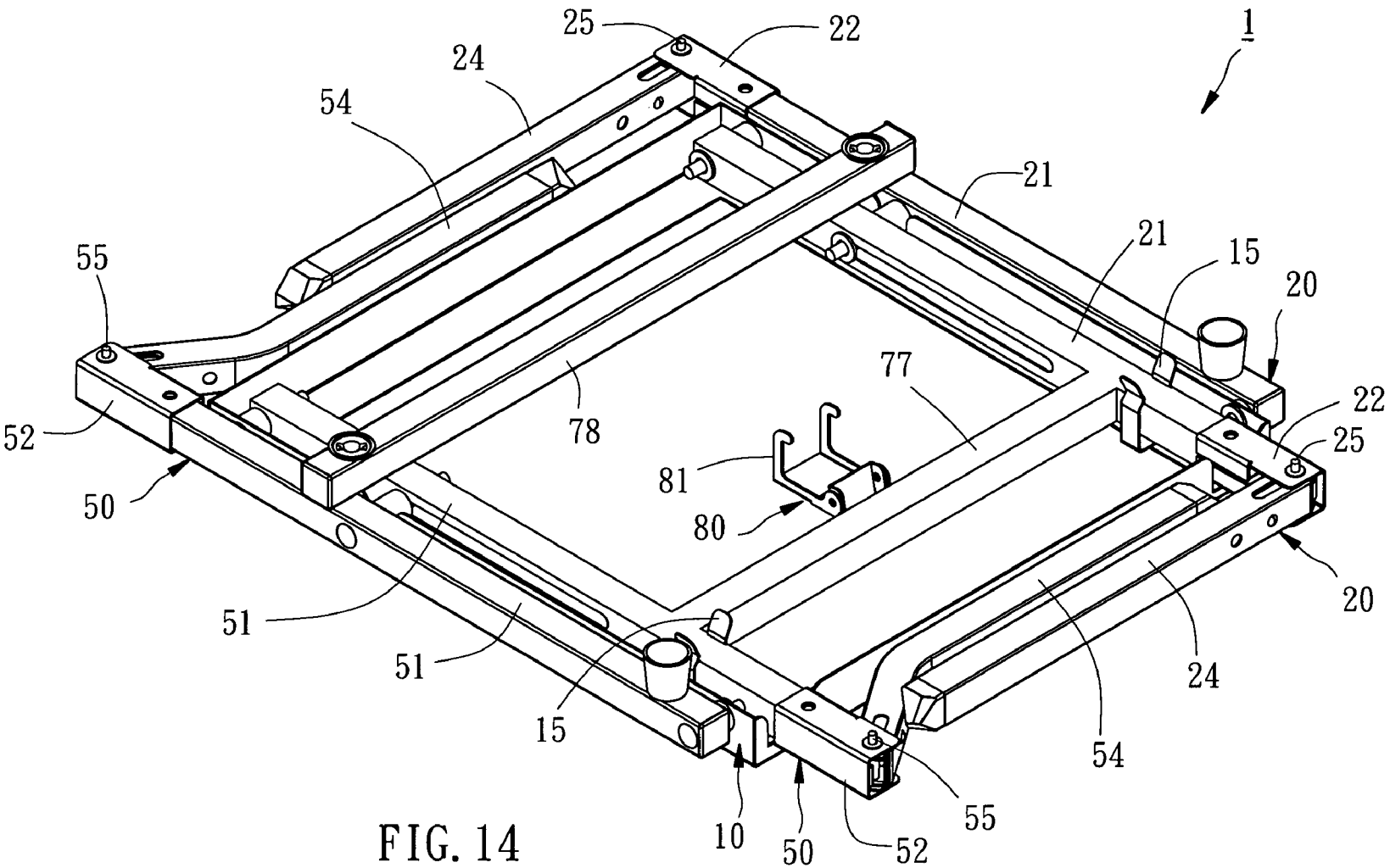
FIG. 14 is a perspective bottom view of the present invention showing the received status of the folding collapsible stand for table saw.
Figure 15:
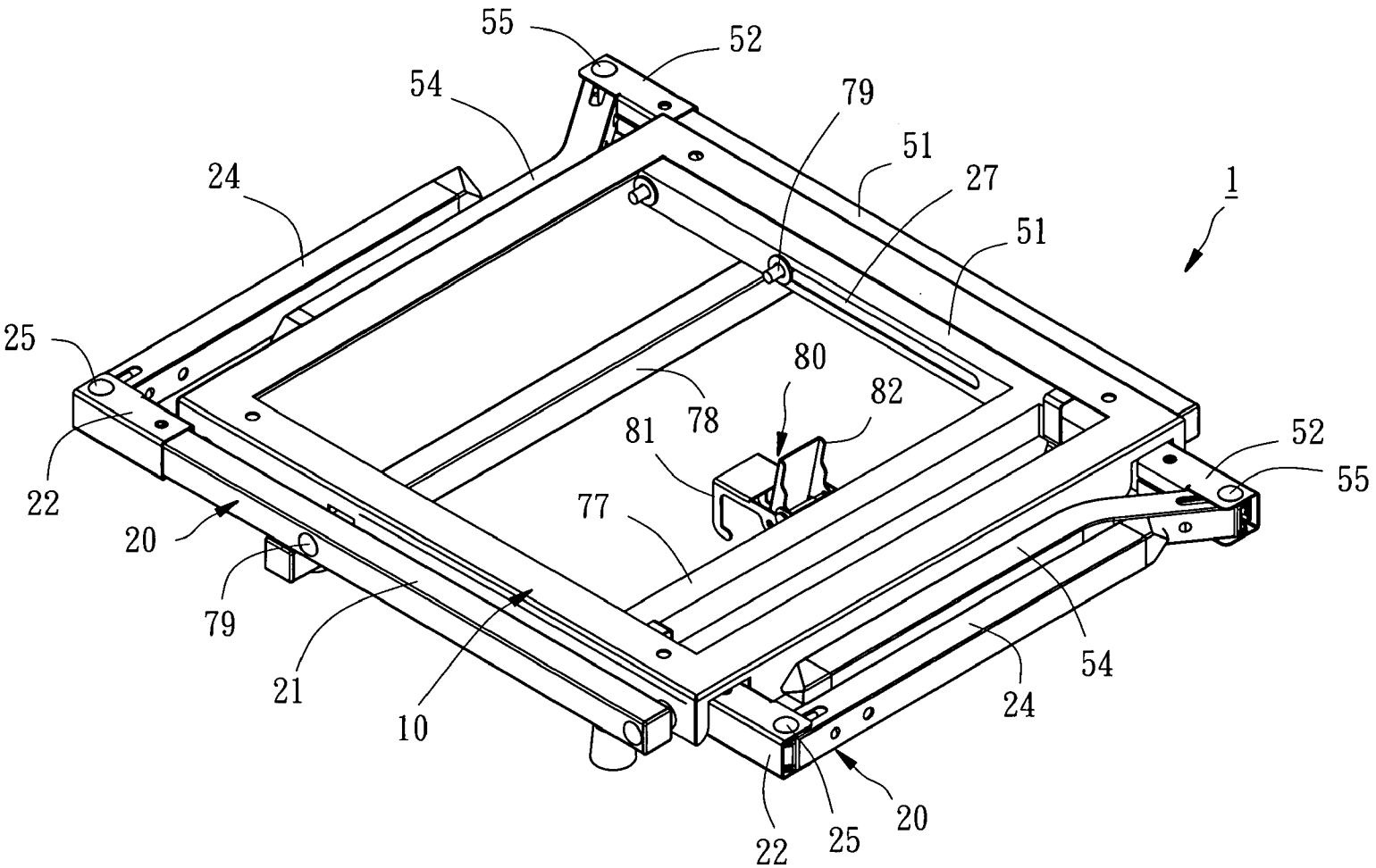
FIG. 15 is a perspective top view of FIG. 14.

When collapsing the first legs 20, as shown in FIGS. 12 and 13, press the knobs 41 inwardly away from the corresponding locating holes 43, and then pull the respective bottom tubes 24 out of the respective top tubes 21 to the extent that the pivots 25 are respectively stopped at the respective top edges 45 of the respective longitudinal slots 42, and then turn the respective bottom tubes 24 about the respective pivots 25 toward the corresponding bottom notches 31, as shown in FIGS. 14 and 15, to force the top bearing portions 39 of the curved stop plates 37 against the inside walls of the corresponding coupling tubes 22. At this time, the top tubes 21 and the bottom tubes 24 are arranged at right angles, and the folding collapsible stand 1 is received in the collapsed status.

As indicated above, the folding collapsible stand 1 can be received in the collapsed status to reduce space occupation when not in use. When in use, the folding collapsible stand 1 supports the table saw 90 on the floor at the suitable elevation for cutting the workpiece.

What is claimed is:

1. A folding collapsible stand for supporting a table saw, comprising a plurality of folding collapsible legs turnable between an extended position for supporting the table saw and a received position received to the bottom side of the table saw, wherein said folding collapsible legs each comprise a top tube, a bottom tube, a connector, and a pivot, a coupling tube having a bottom end, a pivot hole transversely disposed near the bottom end, and a notch disposed at an inner side and longitudinally extended to the bottom end, said bottom tube having a top end, a longitudinal slot and a locating hole disposed in an upper part thereof, said connector having a base fitted into the top end of said bottom tube, a through hole extended through two opposite sidewalls of said base, two bottom extension strips respectively downwardly extended from said base at two sides, two knobs respectively formed on said bottom extension strips at an outer side remote from said base, and a top stop device formed on a top side of said base; said pivot being inserted through the pivot hole of said top tube, the longitudinal slot of said bottom tube and the through hole of said base of said connector to pivotally secure said bottom tube to said connector and said top tube such that when the corresponding folding collapsible leg is turned to said extended position, the knobs of said connector are respectively engaged into the locating hole of said bottom tube and said pivot is stopped at a bottom end of said longitudinal slot; when pressed said semispherical knobs inwards, said semispherical knobs are respectively disengaged from the locating hole of said bottom tube for enabling said bottom tube to be pulled downwards relative to said top tube to move said pivot to a top end of said longitudinal slot and then turned about said pivot toward said notch to said received position to force said stop device against an inside wall of said top tube.

2. The folding collapsible stand as claimed in claim 1, wherein said stop device of said connector comprises a curved stop plate formed integral with and extended from said base, said curved stop plate having a bottom sloping portion obliquely extended from said base and a top bearing portion horizontally extended from a top side of said bottom sloping portion, said top bearing portion being stopped against the inside wall of said top tube to hold the corresponding folding collapsible leg in said received position when said bottom tube is turned to a position perpendicular to said top tube.

3. The folding collapsible stand as claimed in claim 2 further comprising a rectangular top frame for fixedly fastening a bottom wall of said table saw, said rectangular top frame having a front bar and a rear bar; said folding collapsible legs include two first folding collapsible legs and two second folding collapsible legs, the top tubes of said two first folding collapsible legs being respectively pivoted to an outer side of said front bar of said rectangular top frame, the top tubes of said two second folding collapsible legs being respectively pivoted to an inner side of said rear bar of said rectangular top frame.

4. The folding collapsible stand as claimed in claim 3, wherein the top tubes of said second folding collapsible legs each have a longitudinal guide slot, the top tubes of said first folding collapsible legs each have a through hole respectively pivotally connected to the longitudinal guide slots of the top tubes of said second folding collapsible legs by a respective pivot, which is stopped at a bottom end of the corresponding longitudinal guide slot when the corresponding folding collapsible tube set in said extended position, or stopped at a top end of the corresponding longitudinal guide slot when the corresponding folding collapsible tube set in said received position.

5. The folding collapsible stand as claimed in claim 4 further comprising a locking device for locking said folding collapsible legs in said extended position.

6. The folding collapsible stand as claimed in claim 5, wherein said first folding collapsible legs are respectively connected to said second folding collapsible legs by a respective crossbar; said locking device comprises a hook pivoted to the crossbar between one of said first folding collapsible legs and one of said second folding collapsible legs for hooking on the crossbar between the other of said first folding collapsible legs and the other of said second folding collapsible legs to hold said first folding collapsible legs and said second folding collapsible legs in said extended position.

7. The folding collapsible stand for table saw as claimed in claim 6, wherein said rectangular top frame comprises two clamping plates bilaterally disposed at a bottom side for holding said second folding collapsible legs in said received position.

* * * * *